US008961152B2

(12) United States Patent
Wark et al.

(10) Patent No.: US 8,961,152 B2
(45) Date of Patent: Feb. 24, 2015

(54) PORTABLE FAN

(76) Inventors: Cynthia Wark, Spring, TX (US); Justin James Paul Bennett, Redford Township, MI (US)

( * ) Notice: Subject to any disclaimer, the term of this patent is extended or adjusted under 35 U.S.C. 154(b) by 366 days.

(21) Appl. No.: 13/545,036

(22) Filed: Jul. 10, 2012

(65) Prior Publication Data

US 2012/0275940 A1 Nov. 1, 2012

Related U.S. Application Data

(63) Continuation-in-part of application No. 12/466,736, filed on May 15, 2009, now Pat. No. 8,235,686.

(51) Int. Cl.

| | |
|---|---|
| ***F04B 35/04*** | (2006.01) |
| ***F04D 25/08*** | (2006.01) |
| ***F04D 25/06*** | (2006.01) |
| ***F04D 29/08*** | (2006.01) |
| ***F04D 29/60*** | (2006.01) |

(52) U.S. Cl.

CPC ..... *F04D 25/084* (2013.01); *F04D 25/0673* (2013.01); *F04D 29/083* (2013.01); *F04D 29/601* (2013.01)

USPC ..... 417/423.15; 417/423.7; 417/423.14

(58) Field of Classification Search

CPC . F04D 29/646; F04D 29/4253; F04D 25/084; F04D 25/086; F04D 25/10; F04D 25/105

USPC ..... 416/63, 244 R; 417/360, 411, 423.1, 417/423.7, 423.9, 423.14, 423.15

See application file for complete search history.

(56) References Cited

U.S. PATENT DOCUMENTS

| | | | | |
|---|---|---|---|---|
| 5,256,039 | A * | 10/1993 | Crawford | 417/234 |
| 5,285,953 | A * | 2/1994 | Smith | 220/737 |
| D400,668 | S * | 11/1998 | Bloom | D23/379 |
| 6,109,874 | A | 8/2000 | Steiner et al. | |
| 6,155,782 | A | 12/2000 | Hsu | |
| 6,179,564 | B1 | 1/2001 | Park | |
| 6,227,004 | B1 | 5/2001 | Gerstein | |
| 6,409,475 | B1 * | 6/2002 | Ho | 416/63 |
| 6,454,539 | B1 * | 9/2002 | Santos | 417/44.1 |
| 7,089,749 | B1 | 8/2006 | Schafer | |
| 7,775,848 | B1 * | 8/2010 | Auerbach | 446/73 |
| 2003/0059307 | A1 * | 3/2003 | Moreno et al. | 416/142 |
| 2005/0088866 | A1 * | 4/2005 | Levine | 363/146 |
| 2008/0035662 | A1 | 2/2008 | Way | |
| 2008/0069694 | A1 * | 3/2008 | Hernandez et al. | 416/63 |
| 2008/0237900 | A1 | 10/2008 | Junkel et al. | |

* cited by examiner

*Primary Examiner* — Peter J Bertheaud
*Assistant Examiner* — Dnyanesh Kasture
(74) *Attorney, Agent, or Firm* — Young Basile Hanlon & MacFarlane P.C.

(57) ABSTRACT

Portable battery-operated fan comprises a two-part base of which the lower part can be detached to allow the fan to stand on its own or attached to permit the fan to be placed in a cup or bottle holder. A facsimile of an element of sports apparatus such as a golf ball, basketball, or bowling pin is pivotally attached to the fan and provides a mounting place for a DC motor which is driven by a battery in the lower base. A shrouded fan is attached to an end or a side of the sports apparatus facsimile so as to provide cooling air flow on demand.

3 Claims, 7 Drawing Sheets

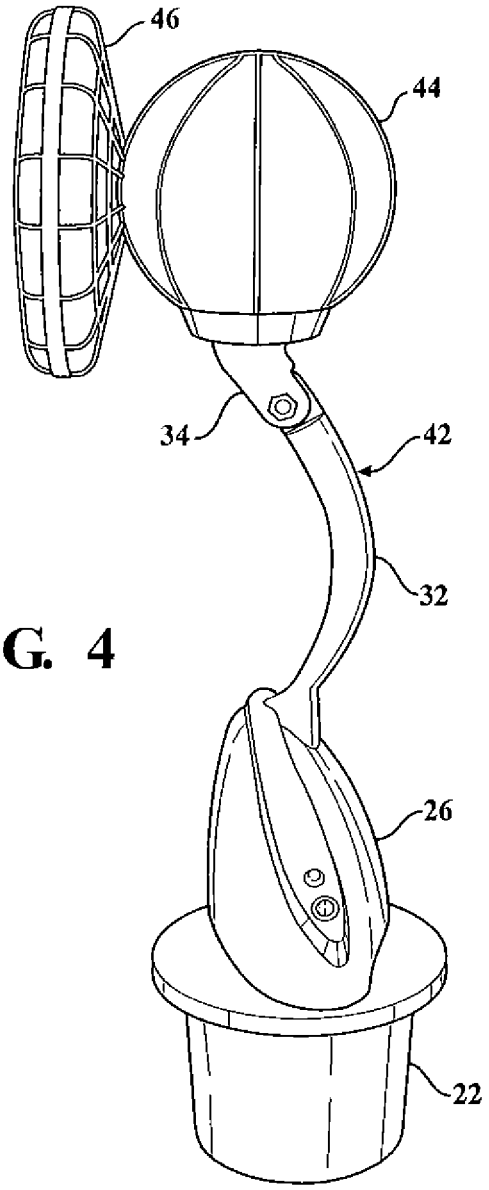
FIG. 4
FIG. 5
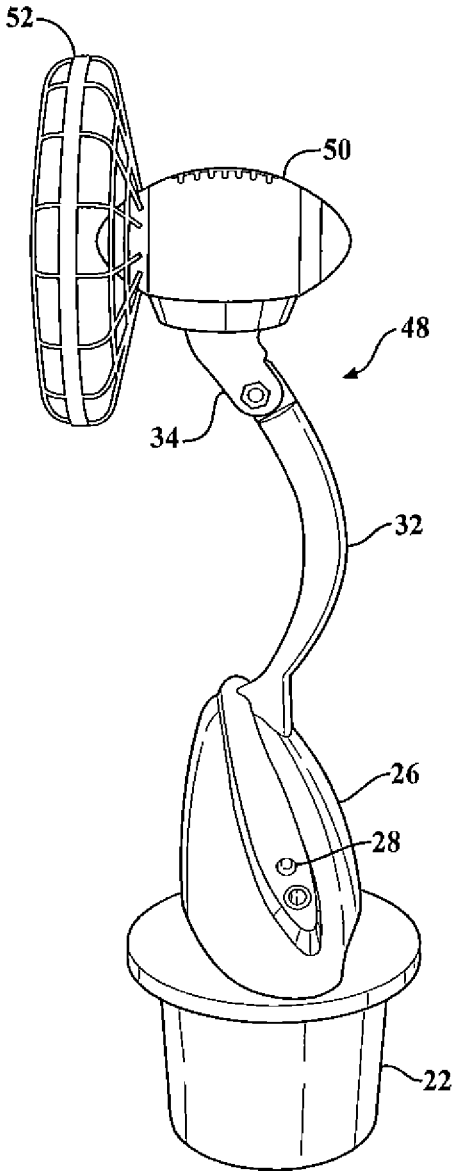

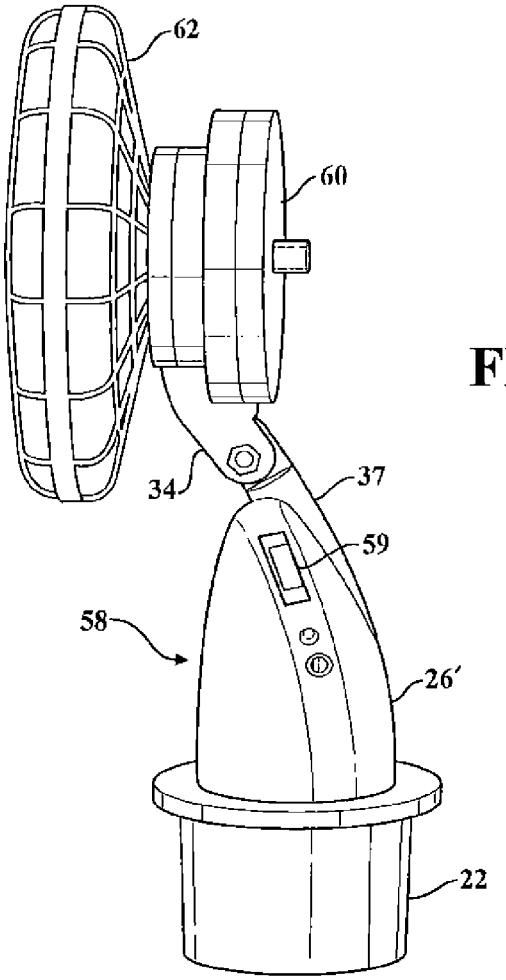
FIG. 8
FIG. 9
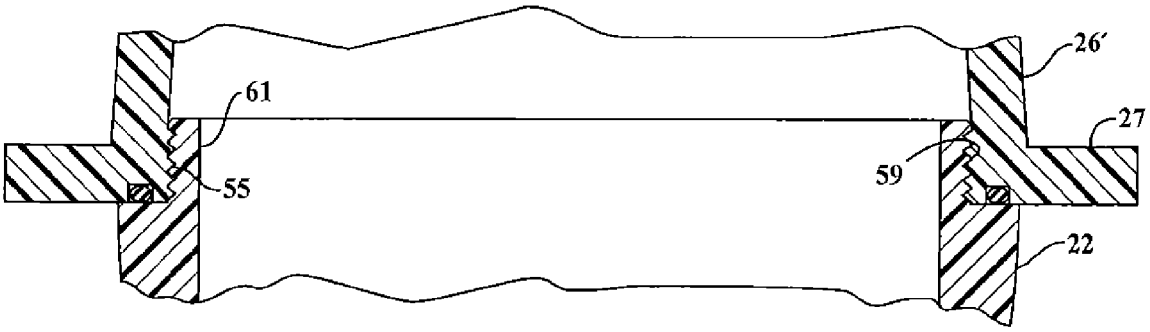

PORTABLE FAN

RELATED APPLICATION INFORMATION

This application is being filed as a continuation-in-part of application Ser. No. 12/466,736 filed May 15, 2009, the entire disclosure of which is incorporated herein by reference.

FIELD OF THE INVENTION

The invention relates to portable fans and more particularly to a portable fan that can stand on its own or fit into a cup or bottle holder of the type found in recreational vehicles, on exercise equipment or in other associations. In a preferred embodiment, the fan incorporates a facsimile of a popular piece of sports apparatus such as a golf ball, baseball, football, volleyball, basketball, soccer ball, bowling pin, or exercise weight or weight set.

BACKGROUND OF THE INVENTION

Numerous battery-operated portable fans have been disclosed in the patent literature. Several such fans are adapted to be handheld or draped around the neck by the way of a lanyard or simply laid on its side. None of the prior art fans of which Applicants are aware is designed for multiple environments, or to be conveniently placed in a generally cylindrical, concave receptacle such as a cup or bottle/can holder, nor is any of the prior art fans of which Applicants are aware associated by structure and appearance with a particular sports activity.

SUMMARY OF THE INVENTION

A portable fan is disclosed herein comprising a body which, in the preferred form, can stand on its own or fit into a cup or bottle holder. In addition, the variously illustrated embodiments incorporate into their structure an element which is associated with a sport or recreational activity. The fan body may be made in upper and lower parts which are threadably engageable with one another to provide multiple use arrangements. In the illustrated embodiments, the fan incorporates sports apparatus facsimile providing a motor compartment. The motor has an output shaft which is arranged at an angle to the longitudinal axis of the body which, in use, is generally vertical. In addition, the subject fan comprises a set of fan blades attached to the motor output shaft and, in the preferred form, the blades may be shrouded for protection.

The fan of the present invention may comprise additional features such as a curved neck between the upper body and the sports facsimile. In addition, the sports apparatus facsimile may take any of a wide variety of forms such as a golf ball, football or soccer ball, as well as a bowling pin or an exercise weight. This list is not exhaustive.

The term "sports apparatus facsimile" as used herein refers generally to a body which essentially replicates the appearance features of an element of sports equipment and is not necessarily an exact copy based on size, weight or surface finish, nor is the facsimile intended to be usable in a sports activity or play.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF SUMMARY OF THE DRAWINGS

The description herein makes reference to the accompanying drawings wherein like reference numerals refer to like parts throughout the several views and wherein:

FIG. 4 is a perspective view of still another embodiment of the invention wherein the sports apparatus facsimile is the appearance of a basketball;

FIG. 5 is a perspective view of still another embodiment of the invention wherein the sports apparatus facsimile has the shape and appearance of a football;

FIG. 8 is a perspective view of still another embodiment of the invention wherein the sports apparatus facsimile comprises a set of exercise weights;

FIG. 9 is a cross-sectional detail showing the manner in which the upper and lower parts of the fall housing threadably engageable with one another and sealed by means of an O-ring seal;

DETAILED DESCRIPTION OF THE ILLUSTRATIVE EMBODIMENTS

Figure 1:
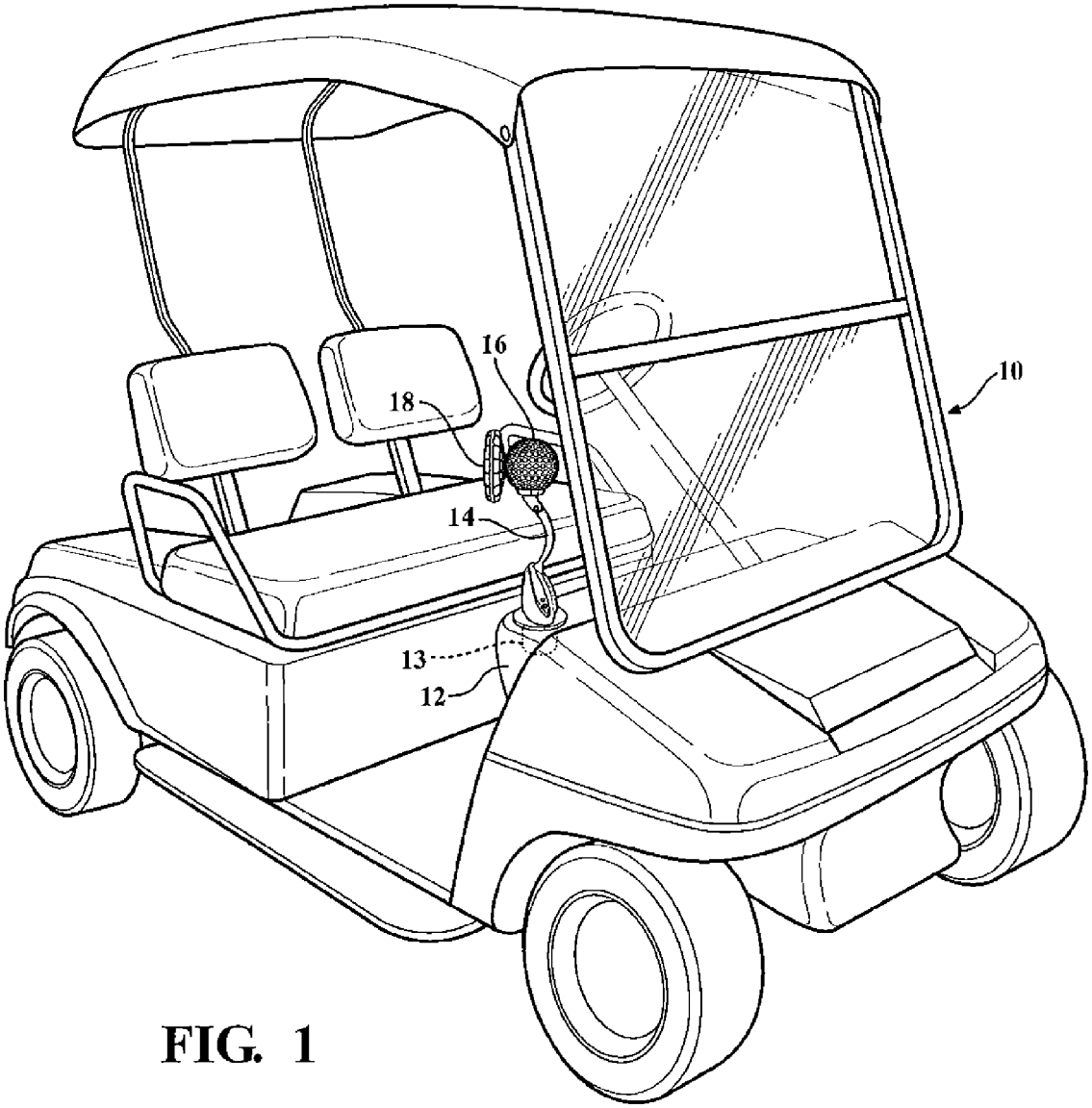
FIG. 1 is a perspective view of a golf cart in which a portable fan constructed in accordance with the principles of the present invention is shown resting in a cup holder and incorporating a sports apparatus facsimile having the appearance of a golf ball albeit somewhat larger in size than a regulation golf ball.

FIG. 1 shows a motorized golf cart 10 having a dashboard 12 with a cup holder 13, in this case holding a fan 14 which incorporates into the structure thereof a facsimile 16 of a golf ball, albeit somewhat larger in size to accommodate a DC motor for a shrouded fan 18 which is mounted pivotally to the fan 14 so that the angle of the fan rotational axis, which is also the axis of the motor within the golf ball replica 16, can be adjusted relative to the vertical axis of the fan 14 while in use.

Figure 2:
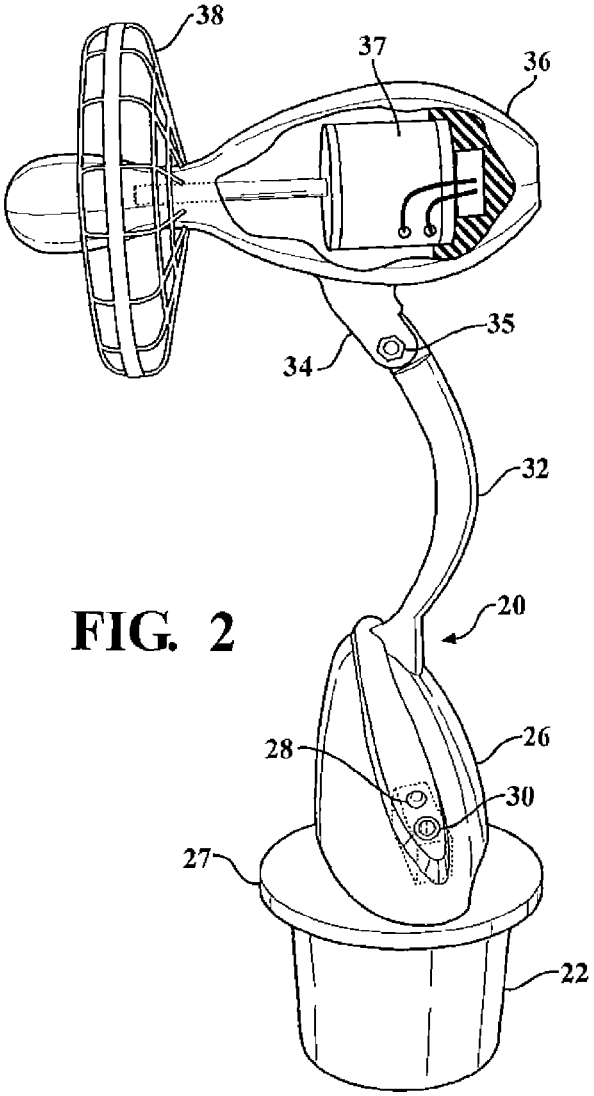
FIG. 2 is a perspective view of a second embodiment of the invention incorporating a two-piece body with an elongate neck attached to the upper part of the body and a motor housing in the shape and appearance of a bowling pin pivotally attached to the upper end of the curved neck and extending through the centerline of a fan shroud.

FIG. 2 shows additional detail of another embodiment of a fan 20 having a two-piece body comprising a generally cylindrical but slightly tapered molded plastic base 22. The base 22 is attached by a threaded connection shown in detail in FIG. 9 to an upper body part 26 which carries an Off/On switch 28 and a charging port 30 and provides a compartment for a lithium-ion rechargeable battery. An elongate curved neck 32 is fixedly attached to the upper body part 26 and carries at the upper end a bracket 34 which is pivotally attached to the neck by a fastener 35. Attached to the bracket 34 is a facsimile or replica 36 of a bowling pin containing a pocket for a brushless DC motor 37 having an output axis which lies at an angle to the longitudinal axis of the base 22. That axis is vertical or substantially vertical when the fan 20 is in use. The bowling pin replica 36 extends through a fan shroud protecting users from a rotary blade 38 driven by the motor 37 to provide cooling on demand. The motor 37 preferably has ball bearings for low friction and long life. The body part 26 has an integral bottom flange 27 that provides stability when the bottom 22 is detached and the user wishes to stand the fan on a table. The flange also provides a stop when the bottom 22 is attached and inserted into a cup or bottle holder.

Figure 3:
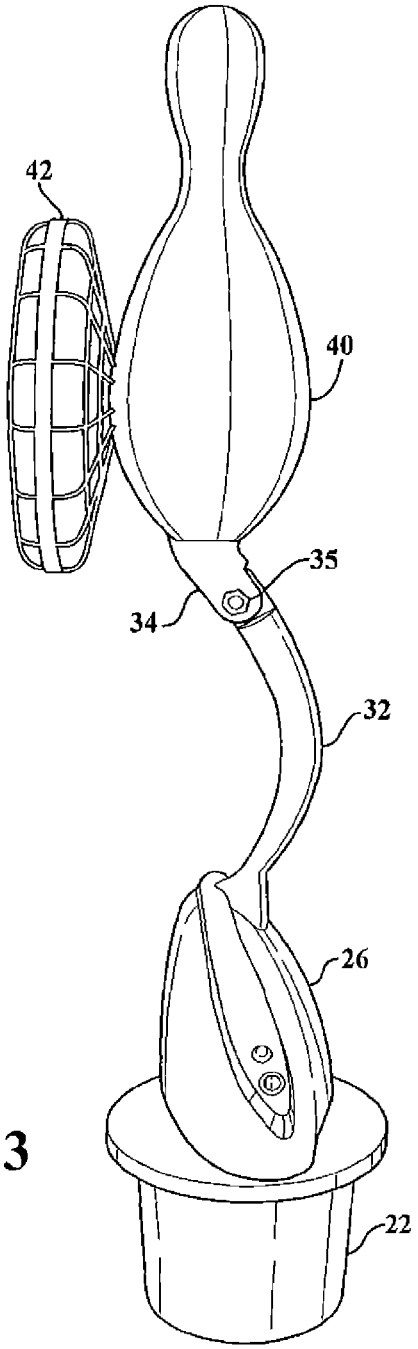
FIG. 3 is a perspective view of another alternative embodiment of the invention, again using a bowling pin as the sports apparatus facsimile but with the pin in a different orientation than that shown in FIG. 2.

FIG. 3 shows another embodiment with an identical base 22 having an identical upper body portion 26 to the embodiment shown in FIG. 2. The FIG. 3 embodiment likewise comprises a curved fixed neck 32 pivotally attached to a bracket 34. Another bowling pin replica 40 is attached to the bracket 34, in this case with the bowling pin replica in an upright position and a shrouded fan 42 attached to the side of the bowling pin replica 40. A motor (not shown) is encased in the pin replica 40 and drives a fan about an axis of rotation which is essentially at right angles to the vertical axis of the base 22 but the position of the fan axis may be adjusted by simple manipulation of the pivot fasteners 35.

FIG. 4 shows a further embodiment of the fan 42 in which the parts which are identical to those in the embodiments of FIGS. 2 and 3 are similarly numbered. Attached to the bracket 34 is a replica of a basketball 44 carrying a shrouded fan 46 attached to the side of the basketball replica 44. Again, a DC motor (not shown) is housed within the basketball replica 44. A motor, like the embodiments of FIGS. 2 and 3 is driven by a battery carried in a compartment found in the upper body 26. A charging circuit (not shown) is housed in body portion 26.

FIG. 5 shows still a further embodiment of a fan 48 in which the parts identical to the embodiments of FIGS. 2, 3 and 4 are similarly numbered. In the FIG. 5 embodiment, the bracket carries a football facsimile 50 attached to a shrouded fan 52 so that an end of the football facsimile protrudes into the center of the fan shroud. A DC motor (not shown) is carried within the football replica 50 to drive the fan when turned on by the switch 28.

In all cases described thus far, the components 22, 26, 30 and 32 are preferably made of high density injection molded polyethylene, but other plastics and other materials may be used. The bracket 34 may also be made of plastic but may also be made of a lightweight metal such as aluminum. In all cases, the spoils apparatus replicas 16, 36, 40, 44 and 50 are made of injection molded plastic and can have smooth or textured surface finishes.

Figure 7:
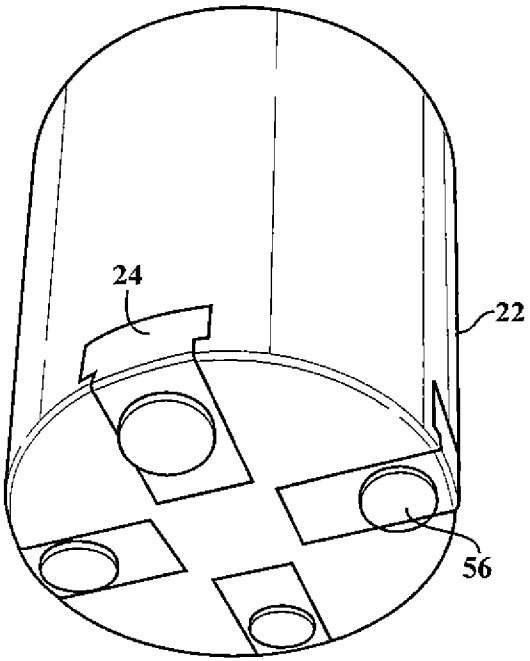
FIGS. 6 and 7 are perspective views of an alternative lower portion of the fan body wherein the lower portion has radially extendible feet.
Figure 6:
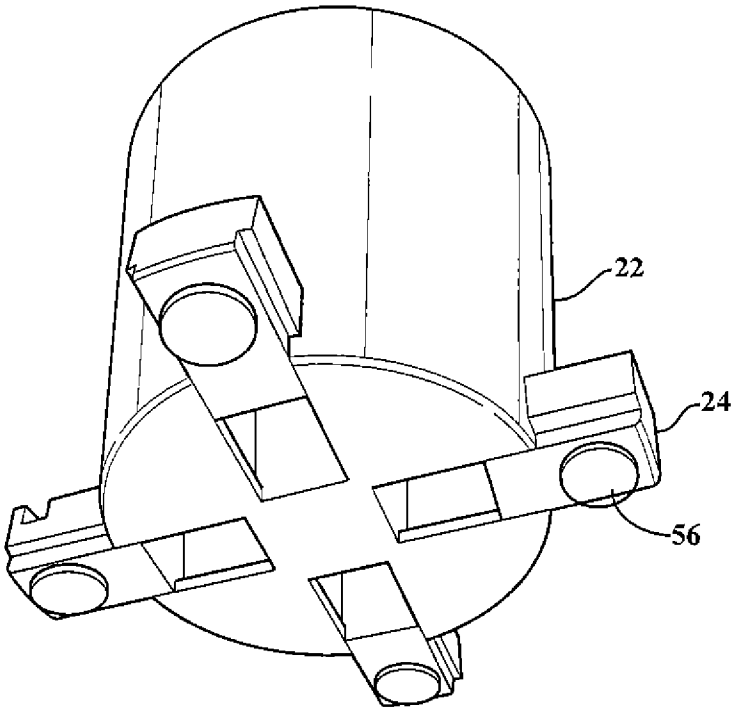

FIGS. 6 and 7 show the bottom or base 22 with optional, extendible feet 24. Pads 56 are provided.

Figure 10:
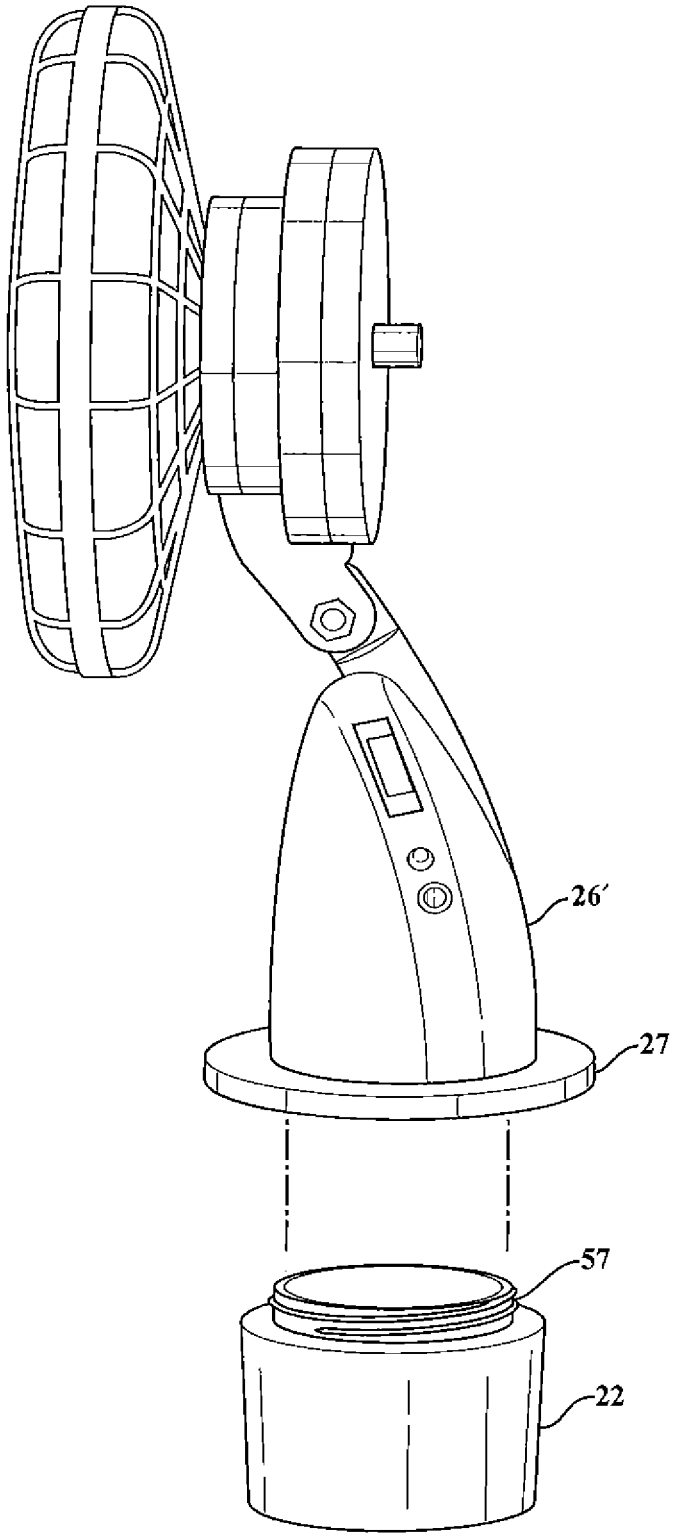
FIG. 10 is a perspective view of the embodiment of FIG. 8 with the upper and lower parts of the body disengaged from one another.

FIGS. 8 and 10 show still another embodiment in the form of a fan 58 having a base 22 and a slightly modified upper body 26' with fan speed control switch 59. A bracket 34 is attached to the upper body by means of a short neck 37. The bracket is permanently attached to a molded plastic replica of a set of exercise or barbell weights 60 which also houses a fan motor. The barbell weight replica 60 is permanently attached to the shrouded fan 62 which may be activated on demand by drawing power from the battery stored within the compartment provided by body 26.

FIG. 10 shows the fan of FIG. 9 with the bottom 22 disassembled. The flange 27 on the body part 26 is shown as having internal threads 55 while complemental external threads 57 are provided on a reduced diameter portion 61 of the bottom body part 26' so that the two components can be threaded together, if desired. Flange 27 provides stability to allow the fan to stand on its own.

Figure 11:
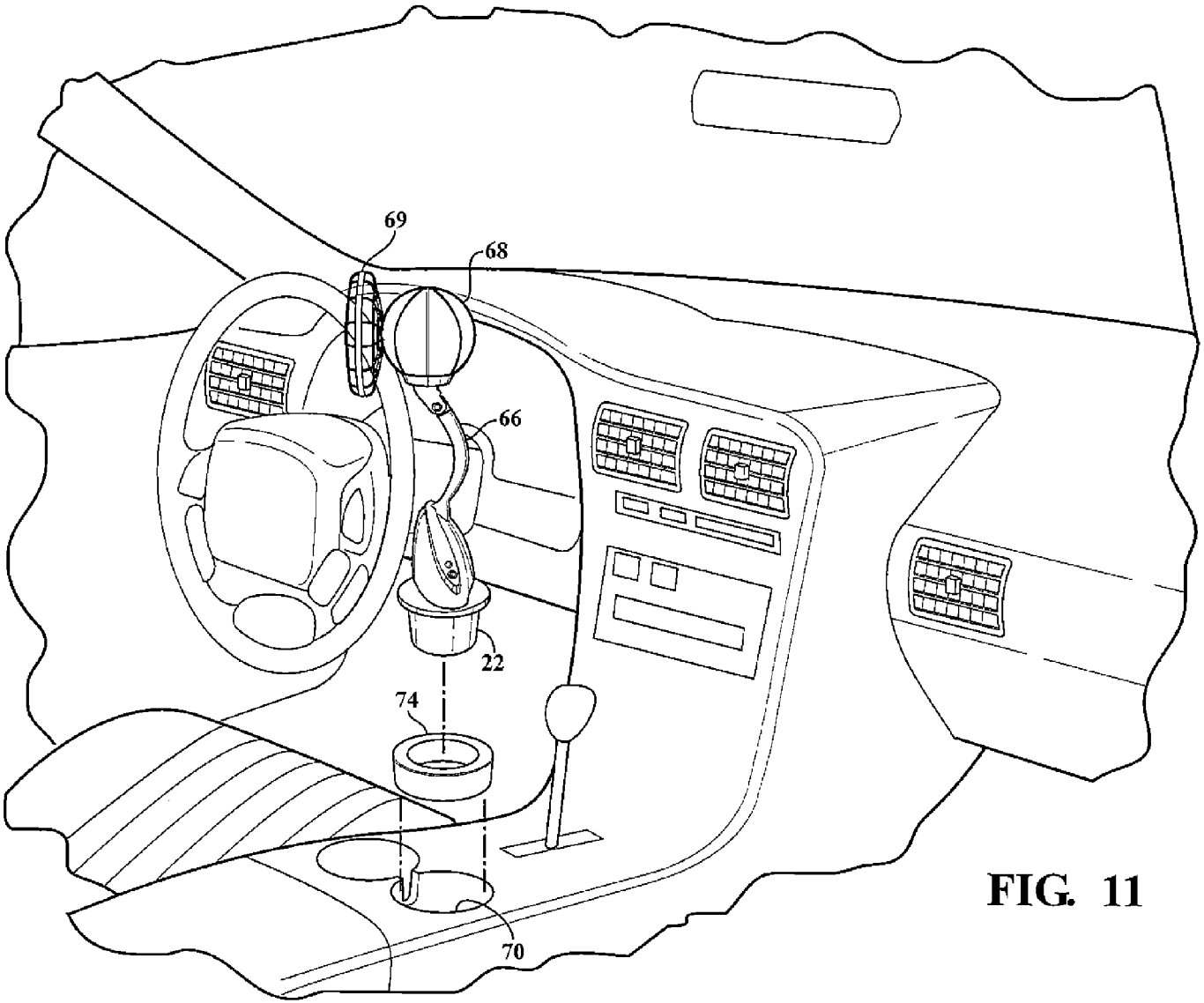
FIG. 11 is a perspective view of the embodiment of the invention shown in FIG. 4 with an adapter which allows the lower portion of the body to be placed snugly and securely in a bottle holder which is large in diameter than a traditional hot drink cup holder.

FIG. 11 shows still another embodiment in the form of a fan having a detachable tapered cylindrical bottom 22, a long neck 66, and attached to the long neck 66, a smaller replica of a basketball 68. The basketball may be differently decorated to represent a tennis ball, a volleyball, a baseball, a softball or any other round object intended for sports play. A shrouded fan 69 is attached to the basketball replica 68 to blow fan at an angle to the vertical axis of the fan when it is placed in a bottle holder 70 in a center console of an automotive vehicle. In this case, the diameter of the bottom 22 is smaller than the diameter of the bottle holder 70. Accordingly, an adapter ring 74 preferably made of medium density closed-cell plastic is provided to snugly fit around the outside of the bottom 22 and take up the space between the bottom 22 and the bottle holder 70 so as to provide a snug fit when the fan is placed upright in the center console 72.

In all cases, the fan preferably has two blades for high efficiency but the designer may choose a higher number as desired. While a rechargeable lithium ion battery is preferred, multiple C or D cell battery units are equally feasible.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A battery-powered multi-purpose fan comprising:

a molded plastic body providing a battery compartment and having at least one motor control switch mounted thereon; said body having a flange at the lower end thereof with a flat bottom surface;

a base threadedly attachable to the flange and having a tapered cylindrical shape adapted for insertion into a cup holder;

a motor housing in the form of one of: a golf ball, a bowling pin, a basketball, a football, and a set of barbell weights;

a DC motor disposed in the housing and having a propeller shaft extending through the housing;

a propeller mounted on said shaft;

a neck structure attaching the body to the motor housing and having a single axis pivot with a threaded fastener therein for changing the angle of the propeller shaft relative to the body; and a molded plastic shroud mounted to the motor housing and surrounding the propeller.

2. A battery-powered portable fan as described in claim 1 wherein the molded plastic body contains a lithium ion battery.

3. A battery powered fan as described in claim 1 further comprising a cylindrical adapter ring adapted to be placed on and around the base in coaxial relation thereto for adapting the diameter of the base to a particular cup holder.

* * * * *